United States Patent [19]

Vartanian

[11] 4,141,720

[45] Feb. 27, 1979

[54] TANTALUM POWDER RECLAIMING

[75] Inventor: Haig Vartanian, Newton, Mass.

[73] Assignee: NRC, Inc., Newton, Mass.

[21] Appl. No.: 906,150

[22] Filed: May 16, 1978

[51] Int. Cl.[2] ..... B22F 9/00

[52] U.S. Cl. ..... 75/0.5 BB; 75/84.4

[58] Field of Search ..... 75/0.5 BB, 84.4

[56] References Cited

U.S. PATENT DOCUMENTS

| | | | |
|---|---|---|---|
| 2,950,185 | 8/1960 | Hellier et al. | 75/0.5 BB |
| 3,697,255 | 10/1972 | Baldwin et al. | 75/0.5 BB |
| 3,829,310 | 8/1974 | Mahy | 75/0.5 BB |
| 3,992,192 | 11/1976 | Vartanian | 75/0.5 BB |
| 4,067,736 | 1/1978 | Vartanian | 75/0.5 BB |

*Primary Examiner*—W. Stallard

*Attorney, Agent, or Firm*—Jerry Cohen

[57] ABSTRACT

Tantalum powders which have high oxygen, high sodium contents are reclaimed for practical applications by treating said powders with selected fused salt compositions. This process converts normally unleachable sodium metatantalate, recognized herein as a significant source of the powder's content of oxygen and sodium, to leachable forms of oxygen and sodium bearing compounds.

The conversion is accomplished by placing the high oxygen, high sodium tantalum powder, containing such metatantalate, in a fused salt bath which has the major portion of its composition equivalent to the final salts composition which would result from a reduction of potassium fluotantalate with sodium metal, under conditions where 90%–95% of required sodium stoichiometry was used and as a minor portion of composition contains small amounts of added potassium fluotantalate. The required amount of potassium fluotantalate is small in relation to the quantity of reclaimable tantalum powder treated by the process; i.e., the weight ratio of tantalum powder to be treated to tantalum contained in the added potassium fluotantalate ($K_2TaF_7$) is in the range of 9:1 - 40:1.

6 Claims, No Drawings

TANTALUM POWDER RECLAIMING

BACKGROUND OF THE INVENTION

The present invention relates to capacitor grade tantalum powders. Such powders are produced by various chemical and electrolytic reduction processes, a principal form of practice of chemical processing being as described in U.S. Pat. No. 2,950,185 to Hellier and Martin. In that processing, potassium fluotantalate double salt is reduced with sodium. The reduction takes place in a molten bath of such salt, per se, or mixed with a diluent salt of sodium chloride, or other alkali metal halides. The quantity of sodium added is normally less than the theoretical amount for complete reaction according to the reduction equation:

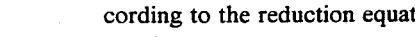

$$K_2TaF_7 + Na \rightarrow Ta + 5NaF + 2KF$$

sodium stoichiometries between 90%-98% are preferred for the production of low oxygen content tantalum powders, which are formed in the molten bath. After reduction, the molten bath is resolidified by cooling. Salt byproducts of the reduction reaction freeze in and around loosely aggregated powder layers and in strata separate from metal-powder-containing layers to comprise an aggregate spongy structure which can be milled to fine size and leached to remove soluble components therein, leaving an insoluble tantalum powder. The powder can be further processed by size segregation, further leaching, and the like. Such powders are sintered into compacts which are formable into capacitor anodes or the like. In some instances in the art, the powders are presintered and milled to produce agglomerates which can be sintered to produce capacitor anodes or the like.

There are several rigid chemical and physical criteria for the quality of the tantalum powders to be usable in producing high quality capacitor anodes and the like. Low oxygen content (below about 1,500 ppm) is essential. During the course of production of the tantalum powders, including the double salt and reducing agent molten bath stage (involving temperatures of 900°-1200° C.) to produce the primary powder, oxygen pick up from processing atmospheres, from impure starting materials and from equipment are ever-present dangers. Where the oxygen is not readily removed in the course of final leaching steps, the resultant high oxygen powder must be recycled or dedicated to a substantially derated usage or scrapped. All three alternatives represent considerable economic loss and waste of a scarce resource since known and practicably available sources of tantalum are limited in relation to present and anticipated demand.

It is therefore an important object of the invention to provide a method for recovering tantalum of high oxygen content to a usable, non-derated form.

It is a further object of the invention to achieve foregoing objective in practical and economic fashion maintaining control over powder size distribution.

It is a further object of the invention to achieve one or more of the preceding objects without undue dangers of reintroducing oxygen or other contamination.

SUMMARY OF THE INVENTION

In accordance with the invention, the high oxygen tantalum powder is mixed with a small amount of potassium fluotantalate. Essentially, the weight ratio of high oxygen tantalum to be recovered as low oxygen tantalum is mixed with potassium fluotantalate in such a ratio that the weight ratio of tantalum to be reprocessed to tantalum content of the double salt is in the range of 9:1-40:1.

German published patent application No. 2,240,658, published Feb. 28, 1974, shows a method of recovery of high oxygen content tantalum or other refractory metals by exposure to a molten salt bath to deoxidize the surface of the metal sheet and thereby create a concentration gradient from the interior to the surface of the sheet so that further absorbed oxygen, incorporated into interstitial sites in the crystal lattice of the metal, will migrate to the surface and be removed by the molten salt. The molten salt can be regenerated by hydrogen treatment for further deoxidizing use. According to the published application, molten salt must contain at least a 10% fluoride component and up to 100% fluoride, and to avoid contamination of the deoxidizing salt bath material by the alkali metal component of an alkali metal fluoride, a fluoride of the refractory metal may also be included.

However, the problems attendant on high oxygen sheets of tantalum is different from that involved in high oxygen sodium-reduced powder. The basis for the present invention is the recognition that a principal source of oxygen contamination in tantalum powders, when it occurs, is that the oxygen occurs in the form of sodium metatantalate included in the tantalum powder and this is indicated by high sodium impurity levels in addition to high oxygen impurity levels. The presence of sodium metatantalate has been confirmed by separating it from the tantalum powder and identifying its crystal lattice by X-ray diffraction techniques. The sodium metatantalate is not readily leachable by leaching compositions or under conditions used to treat the reduction product in the course of the primary metal production. It is a further critical aspect of the present invention that control of effective surface area and size distribution of the powders are maintained.

Other objects, features and advantages of the invention will be apparent from the following detailed description of preferred embodiments thereof.

DETAILED DESCRIPTION OF PREFERRED EMBODIMENTS

Several experimental batches of tantalum powder having oxygen contents of 2102, 4500 and 2930 ppm respectively, were provided in 227 gram batches and combined with mixtures of potassium fluotantalate and mixed halide salts to provide, in relation to the 227 grams of tantalum supplied, 55.4 grams of potassium fluotantalate, 368 grams of sodium fluoride, 539 grams of sodium chloride and 187 grams potassium chloride. This composition corresponds to a fused salt mixture with the following weight and mole ratios:

| | Weight Ratio | Mole Ratio |
|---|---|---|
| Tantalum Powder | 1 | 1 |
| $K_2TaF_7$ | 0.24 | 0.11 |
| K Cl | 0.82 | 2 |
| Na F | 1.62 | 7 |
| NaCl | 2.37 | 7.37 |

Two melts were made with the 2930 ppm powder, which had sodium and potassium levels of 197 and 435 ppm respectively and a nominal size distribution of −100 mesh +325 mesh but, in fact, containing some 50% −325 mesh components. The first melt was conducted according to the nominal amounts of salt given above in relation to the 227 grams of tantalum. The procedure was to dry the mixture of salts in a reactor at 540° C. in a vacuum and then cool to room temperature, release vacuum, add the input tantalum powder to the dried salt, re-evacuate and heat the tantalum powder and salts with mixing to 540° C. under vacuum, backfill with argon at 540° C., purge with argon between 700°-800° C. (at which point the salt mixture would be molten), and heat to 900° C. and hold for three hours before cooling to room temperature. The mixture would then be removed from the reactor, micropulverized, leached in a tank and then further leached in barrels and subsequently dried and screened to desired fractions. Through this processing, oxygen levels were reduced to 650 ppm and sodium and potassium levels were reduced to 16 and 289 respectively.

A second melt, using similar processing, was repeated with double the amount of tantalum (454 grams) relative to the total weight of mixed salts. The 2930 ppm original oxygen was reduced to 570 ppm and the sodium and potassium to 87 ppm and 112 ppm respectively.

The 4500 ppm oxygen powder which had 1399 ppm and 306 ppm sodium and potassium levels, respectively, and a −17 micron +3 micron nominal distribution, were similarly treated using the proportions as shown above and the oxygen level was reduced to 710 sodium to 10 ppm, and potassium to 125 ppm. Powder compacts were pressed from both the original high-oxygen powder and the treated powder (1.8 grams compacts at 8.0 grams/cc green density). These were sintered in vacuum at 1850° C. for 30 minutes, and anodized to 200V in accordance with conventional anodizing practice of the industry. A wet test for capacitance showed average values for anodes of the treated powder of 17.9 microfarads/gm. and 0.82 microamperes/gm. leakage whereas anodes made from the untreated powders could not be measured because leakages values were so high.

Similarly prepared powder compacts were anodized to only 100 volts. Wet test average values for anodes prepared from the treated powder were 35.3 microfarads/gm. and 0.61 microamperes/gm. leakage, versus 36.9 microfarads/gm. and 36.0 microamperes/gm. leakage for anodes prepared from the untreated powder.

A summary of chemical, physical and wet test electrical properties of the treated and original powders are given in Table 1.

A unique feature of this process is the ability to convert high oxygen powder (usually high leakage) to low oxygen content powders which retain a high percentage of the available capacitance of the original powder, thus avoiding relegation of such high oxygen powders to derated applications. Despite the fact that the treated powder does undergo some coarsening, as indicated by an increase in average particle size and screen distribution, its capacitance is only 4.4% less than the original powder. It is found that the described coarsening also serves to improve the handling properties of the powder.

This phenomenon in which an upward shift in source powder size distribution is not accompanied by a corresponding substantial loss of capacitance is believed to be associated with occurrance of what may be termed chemical agglomeration, as distinct from agglomeration resulting from mechanical and thermal (presintering) treatment of powders.

A further run was made as a variation of the last mentioned experiment wherein the salt mixture was premelted at 665° C. before being mixed with tantalum powder, as a method for drying the salt mixture even further. Use of this premelted salt mix resulted in even greater lowering of oxygen, sodium and potassium levels to 46 ppm for oxygen and 7 ppm for sodium and potassium combined.

In all the foregoing experiments, the molten mass of salt containing tantalum powder was stirred although equally satisfactory results were obtained without stirring. It was found that gentle stirring was preferable to more vigorous stirring.

The fused salt-tantalum powder mixture was stirred at 4 rpm in a 4 inch diameter Inconel reactor. The stirred volume was approximately 50 cu. in., and the stirrer had four paddle-type blades of 1 inch × 1 inch dimensions.

TABLE 1

| | O | Na | K | N | FAPD | PR | SBD | - 325M | Capacitance uf/g | | Leakage[c] ua/g | |
|---|---|---|---|---|---|---|---|---|---|---|---|---|
| | | | | | | | | | Formation Voltage | | | |
| | ppm | ppm | ppm | ppm | u | % | g/in$^3$ | % | 200 | 100 | 200 | 100 |
| Source Powder | 4500 | 1399 | 306 | 20 | 6.7 | 72.8 | 51.7 | 100 | [a] | 36.9 | [a] | 36.0 |
| Treated Powder | 710 | 10 | 125 | 34 | 8.0 | 75.0 | 49.5 | 85[b] | 17.9 | 35.3 | 0.82 | 0.61 |

[a]Would not form to 200V
[b]- 200M + 325 M 12.1%
- 100M + 200M 2.4%
40M + 100M 0.5%
[c]200 volt formed anodes tested at 140V
100 volt formed anodes tested at 70V Further numerous experiments were carried out on scaled up versions of the same type of processing. As much as 700 pounds of high oxygen powder was processed in a single batch. The weight ratio of tantalum powders, so processed, to the tantalum content of added amounts of potassium fluotantalate was as great as 40:1. The same qualitative results, as indicated above, were reached in production scale quantities. It was found, however, that in scale up, initially, there was some greater pick-up of iron impurities, apparently from nickel-iron alloy processing equipment used. In subsequent production scale runs, this pick-up was avoided by more careful processing, and by operation below 1000° C.

The preferred ratio of high oxygen tantalum powder to added tantalum (as potassium fluotantalate) according to the described invention should not exceed a 40:1 maximum value. Values somewhat less than this are preferable to insure maximum lowering of oxygen and sodium values. In one particular trial, using the 4500 ppm oxygen powder, wherein no additional potassium fluotantalate was added to the tantalum powder — mixed salts mass, less than optimum reductions occurred; i.e., 4500 ppm to 1820 ppm oxygen, and 1399 ppm to 566 ppm sodium.

The inability to adequately lower oxygen using overly high powder to added tantalum (as potassium fluotantalate) ratios was further demonstrated by treating a typically low oxygen powder ($-17\mu$ $+3\mu$) with fused salt compositions of different ratios. These results are shown in Table 2 and indicate that the maximum usable ratio is about 40:1. Ratios which are much higher, corresponding to fused salt mixtures containing less added potassium fluotantalate actually result in powders with increased levels of oxygen and sodium due to the formation of sodium metatantalate.

TABLE 2

| | Ratio Tantalum Powder: Added Tantalum | ppm 0 | Na | K | N |
|---|---|---|---|---|---|
| Original Powder | — | 776 | 16 | 7 | 16 |
| | 39:1 | 1104 | 169 | 190 | 32 |
| | 19:1 | 450 | 9 | 13 | 34 |
| | 9:1 | 490 | 6 | 18 | 42 |
| | 6:1 | 726 | 7 | 35 | 44 |

The treated powders can be used in presintering agglomeration in the course of capacitor anode production by blending with other simple primary powders to be presintered or by blending with a presintered mass without a distinct thermal presintering of the powders treated in accordance with the present invention. High oxygen powders which are too coarse for capacitor anode application (greater than 50 micron average diameter) were also treated according to the present invention and ground down and presintered in accordance with the conventional presintering processing of primary powders and were found to be equivalent to conventionally prepared presintered powders.

An alternative benefit of the described process for lowering oxygen of coarse powders is to lower the cost of recycling by enabling the use of less costly powder melting procedures.

Under conditions of treatment in accordance with the present invention, inter-particle binding can occur, which is characterized as "chemical agglomeration," since the conditions of treatment of the present invention are involved temperatures much lower than those used for conventional thermal agglomeration of powders. This chemical agglomeration is partially broken up in the course of conventional mechanical handling and leaching subsequent to the molten salt treatment. Alternatively, some of the agglomeration can be preserved in such subsequent steps to deliberatly produce a coarser powder which may be utilized as described above.

The present invention as described above can be used as a selective supplement to primary tantalum powder production processes. The primary production process is the reduction of the type described in the above cited U.S. Pat. No. 2,950,185. It is believed that one of the principal causes of high oxygen powder, when it occurs, is that higher than expected stoichiometry conditions (i.e., high sodium metal content in relation to potassium fluotantalate to be reduced) occurs locally within the reaction mass, leading to the incorporation of sodium metatantalate in the tantalum powder produced by the reduction reaction. As noted above, the sodium metatantalate is not readily leachable. The treatment in accordance with this invention of such high oxygen powder in a salt bath with a small amount of potassium fluotantalate (in relation to the amount of tantalum powder so treated) and no free sodium as such (or very little) presents the opposite condition compared to the primary reaction. That is, the secondary treatment involves sodium starvation, but otherwise essentially replicates the composition of the chemical and physical conditions appearing in the reaction vessel upon the termination of the primary reduction reaction.

In the practice of the invention, the diluent salt comprises an alkali metal fluoride in an amount greater than the alkali metal fluotantalate which is added and sufficient to assure complete wetting of the powder to be treated. Sufficient wetting is indicated by a homogeneous appearance of the entire mass of settled powder (under a top layer of solidified molten salts) in the reactor and after removal therefrom. There is also an alkali metal chloride, preferably and usually in amounts substantially equal to the alkali metal fluoride, but in any event, comprising $\frac{1}{3}$–$\frac{2}{3}$ of the combined fluoride and chloride. The present process operates at sufficiently high temperature to assure melting of the salts, but below 1000° C. to reduce the vulnerability of reactor walls to corrosion or chemical attack by the salt bath and, thereby, avoid new contamination of the treated powder. At this processing temperature (below 1000° C.) and low time of treatment, 10 minutes–10 hours, the effects of oxygen diffusion within the treated powders are not significant for purposes of reclamation.

The tantalum powder added to the salt mixture sinks therein as the salt melts, whether it is a first melting or second melting thereof as described above. Gentle stirring maintains a distribution of the powdered. But the final resolidified bath has the above described homogeneous mix of tantalum powder wetted by the added salts and distributed in the reactor in a lower portion thereof.

The process of the invention is particularly characterized in that the powder treated thereby has substantially the same capacitor manufacturing characteristics, both electrical (same capacitance within about 5%) and from a powder metallurgy standpoint (flow and sinterability), before and after the processing. However, there is some powder coarsening generally and a shift of size distribution therein towards coarser, as noted above.

The invention is particularly applicable to treatment of high specific capacitance powder (over 5,000 microfarad-volts per gram). Tolerable oxygen levels will vary with different levels of size, surface area and capacitance of powders and specific industrial applications thereof (utilization in various capacitor or non-capacitor end products). In general it is found that the practice of the invention produces a halving or better of original excessive oxygen down to a practical limit expressed as the ratio of oxygen content (in ppm) to surface area ($cm^2/gm$) approaching a value of about 0.5. When such ratio is about 0.5, or slightly less a point of diminshing returns for utilization of the present reclamation process has been reached.

The above utilized potassium fluotantalate salt can be substituted, in whole or in part, by other alkali fluotantalates (e.g. $Na_3TaF_8$). Other chlorides can have alkali metal or alkaline earth cations, and other fluorides can have alkali metal cations.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Process of reclaiming high capacitance (over 5000 microfarad-volts/gram) tantalum powder which contains high oxygen (e.g. over 2,000 ppm) in the form of unleachable alkali metal tantalates comprising the steps of:

contacting the tantalum powder with a molten salt bath including an alkali metal fluotantalate and also, a metal fluoride content in excess of the fluotantalate content in an amount effective to insure complete wetting of the treated powder, the weight ratio of treated tantalum to tantalum in the fluotantalate being from 9:1 to 40:1, the treatment being at a temperature sufficient to melt the salts and for a time period of 10 minutes to 10 hours, solidifying the melt and leaching it to remove acid soluble components to thereby produce a low oxygen tantalum powder having substantially the same electrical and powder metallurgy capacitor manufacturing characteristics as before the reclaiming process, and an oxygen (ppm) to surface area ($cm^2/gm$) ratio of no greater than about 0.5.

2. Process in accordance with claim 1 wherein the salt bath further comprises a chloride.

3. Process in accordance with claim 2 wherein the fluoride is an alkali metal fluoride and the chloride is an alkali or alkaline earth metal chloride.

4. Process in accordance with any of claims 1, 2 or 3 wherein the powder is treated in a salt bath which is premelted before admixing with the powder to be reclaimed.

5. Process in accordance with claim 4 wherein the bath comprises sodium chloride-sodium fluoride in substantially equal amounts and potassium floutantalate as a minority component of the bath.

6. Process in accordance with any of claims 1, 2 or 3 wherein said contacting and solidifying steps comprise a secondary treatment following a primary reduction reaction to produce said tantalum powder prior to any utilization of the powder, the secondary treatment constituting a substantial replication of the primary reduction process reaction product composition excepting for sodium starvation relative thereto and the addition of a definite small amount of fluotantalate salt.

* * * * *